US005660458A

United States Patent [19]

Chabria

[11] Patent Number: 5,660,458

[45] Date of Patent: Aug. 26, 1997

[54] FLASHLIGHT

[75] Inventor: Meena G. Chabria, Wayne, Ill.

[73] Assignee: Press-A-Lite Corporation, West Chicago, Ill.

[21] Appl. No.: 550,091

[22] Filed: Oct. 27, 1995

[51] Int. Cl.[6] ..... F21L 7/00

[52] U.S. Cl. ..... 362/189; 362/202; 362/205

[58] Field of Search ..... 362/116, 189, 362/170, 191, 202, 205, 207

[56] References Cited

U.S. PATENT DOCUMENTS

| | | | |
|---|---|---|---|
| 3,796,869 | 3/1974 | Stone . | |
| 4,032,773 | 6/1977 | Halliday, Jr. et al. | 362/189 |
| 4,122,510 | 10/1978 | Halliday, Jr. | 362/189 |
| 4,242,724 | 12/1980 | Stone | 362/189 |
| 4,419,718 | 12/1983 | Chabria | 362/189 |
| 4,524,409 | 6/1985 | Yakubek | 362/189 |
| 4,628,418 | 12/1986 | Chabria | 362/116 |
| 4,644,451 | 2/1987 | Chabria | 362/189 |
| 4,739,455 | 4/1988 | Pullman | 362/189 |
| 4,819,140 | 4/1989 | Griffin | 362/189 |
| 4,885,666 | 12/1989 | Yu | 362/189 |
| 5,097,399 | 3/1992 | Gammache | 362/207 |
| 5,309,336 | 5/1994 | Hartt et al. | 362/207 |
| 5,315,494 | 5/1994 | Maglica | 362/207 |

*Primary Examiner*—James C. Yeung
*Assistant Examiner*—Thomas M. Sember
*Attorney, Agent, or Firm*—Lee, Mann, Smith, McWilliams, Sweeney, & Ohlson

[57] ABSTRACT

A flashlight is provided comprising a housing including a first cradle having a chamber adapted to removably receive a first battery, a second cradle having a chamber adapted to removably receive a second battery, wherein the open tops of the first and second cradles face in generally the same direction relative to one another, and a lamp chamber located within the housing. A lamp is located within the lamp chamber. An electrical switch is adapted to selectively provide electrical communication between the first and second batteries and the lamp. A flexible jacket covers the electrical switch and the first and second batteries and is adapted be pressed inwardly to selectively close the electrical switch and thereby illuminate the lamp. A rotatable stem is attached to the end of the housing and is adapted to selectively retain the flexible jacket in position, but to allow the selective removal of the jacket to permit the replacement of the batteries.

16 Claims, 2 Drawing Sheets

FLASHLIGHT

BACKGROUND OF THE INVENTION

The present invention is directed to a flashlight having a flexible jacket which is adapted to be pressed inwardly to activate a lamp, and in particular to such a flashlight wherein the jacket is selectively removable to allow the selective removal and replacement of the batteries which energize the lamp.

Prior flashlights having a flexible jacket for activating the flashlight, such as disclosed in U.S. Pat. No. 4,419,718, which is assigned to Press-A-Lite Corporation, the applicant herein, include batteries which are not selectively removable and replaceable. Other such flashlights include a housing having oppositely facing concave channels adapted to receive batteries. In such flashlights, it is difficult to retain both batteries in the opposing channels while assembling the flashlight for use as one or the other of the batteries tends to fall out of its channel during assembly. Other flashlights include a housing having oppositely facing channels wherein each channel includes resilient arms which extend around greater than one-half the circumference of the battery. The opposing resilient arms are spaced apart to allow a battery be snapped into or out of the channel. However, the installation and/or removal of a battery from the gripping engagement of the arms of the housing can be difficult, especially for people that may have arthritis or other conditions which effect the use of their hands.

SUMMARY OF THE INVENTION

A flashlight is provided which includes a housing extending between a first end and a second end. The housing includes a first generally semicircular cradle having a chamber with an open top adapted to removably receive a first battery having a first terminal and a second terminal. The housing also includes a second semicircular cradle having a chamber with an open top adapted to removably receive a second battery having a first terminal and a second terminal. The first and second cradles are oriented in the same direction relative to one another such that the open tops of the first and second cradles face in generally the same direction relative to one another. The housing also includes a lamp chamber located at the first end of the housing. A lamp including a first terminal and a second terminal is located within the lamp chamber. An electrical switch provides selective electrical communication between the first and second batteries and the lamp. A resiliently flexible tubular jacket extends around the housing and covers the electrical switch and the first and second batteries. The jacket is adapted be pressed inwardly to close the electrical switch and thereby illuminate the lamp. The first and second cradles allow the easy insertion and removal of the batteries from the respective chambers of the cradles as the cradles do not grip the batteries. When the open tops of the cradles are oriented upwardly, the cradles retain the batteries during the assembly of the jacket over the housing and the installed batteries. The jacket is selectively retained in place over the switch and batteries by a cap which is selectively removably connected to the second end of the housing by a stem. The stem is rotatably attached to the second end of the housing and extends through an aperture in the cap.

DETAILED DESCRIPTION OF THE PREFERRED EMBODIMENT

Figures 1, 2:
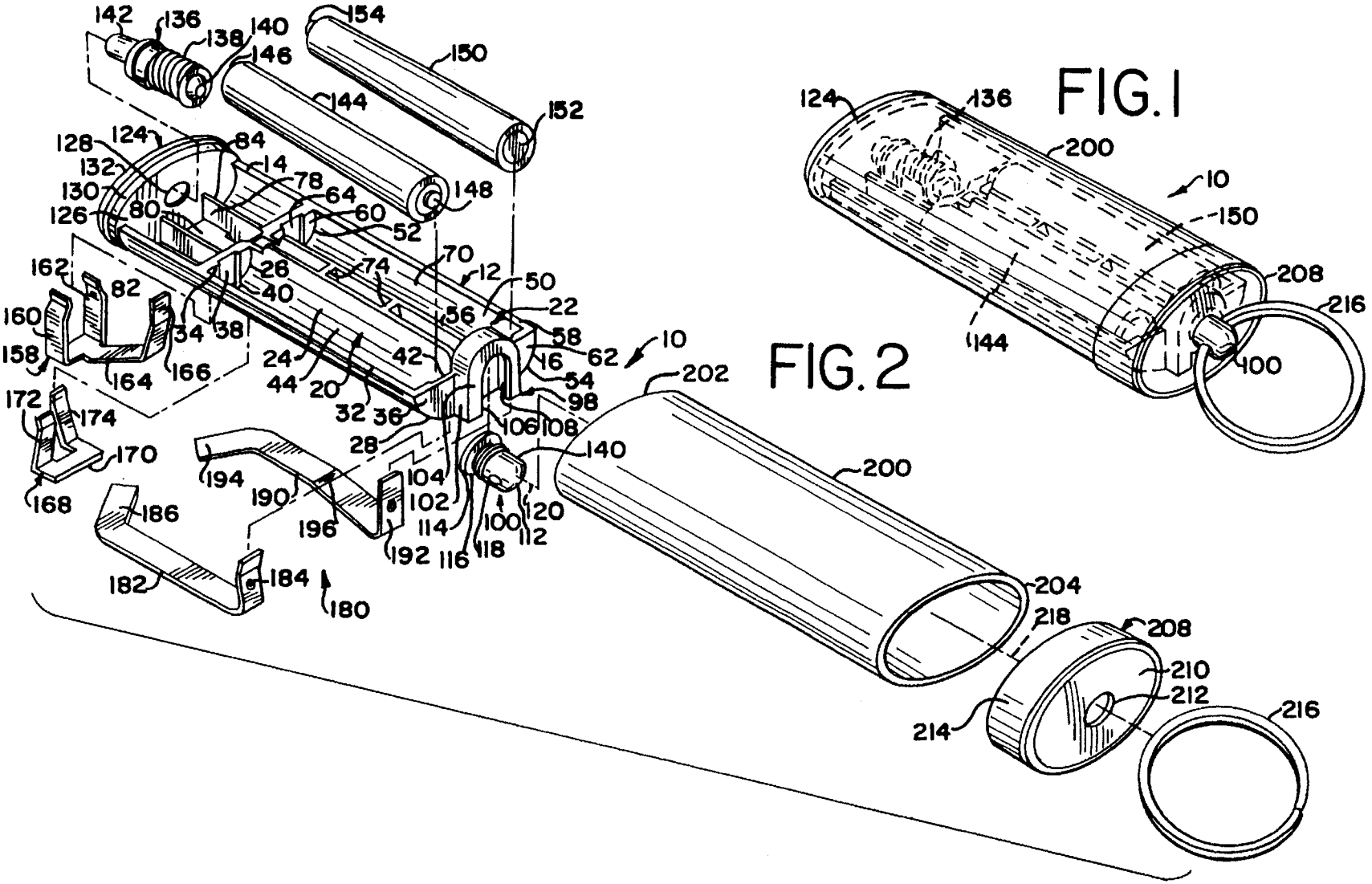
FIG. 1 is a perspective view of one embodiment of the flashlight of the present invention.
FIG. 2 is an exploded view of the flashlight.
Figure 3:
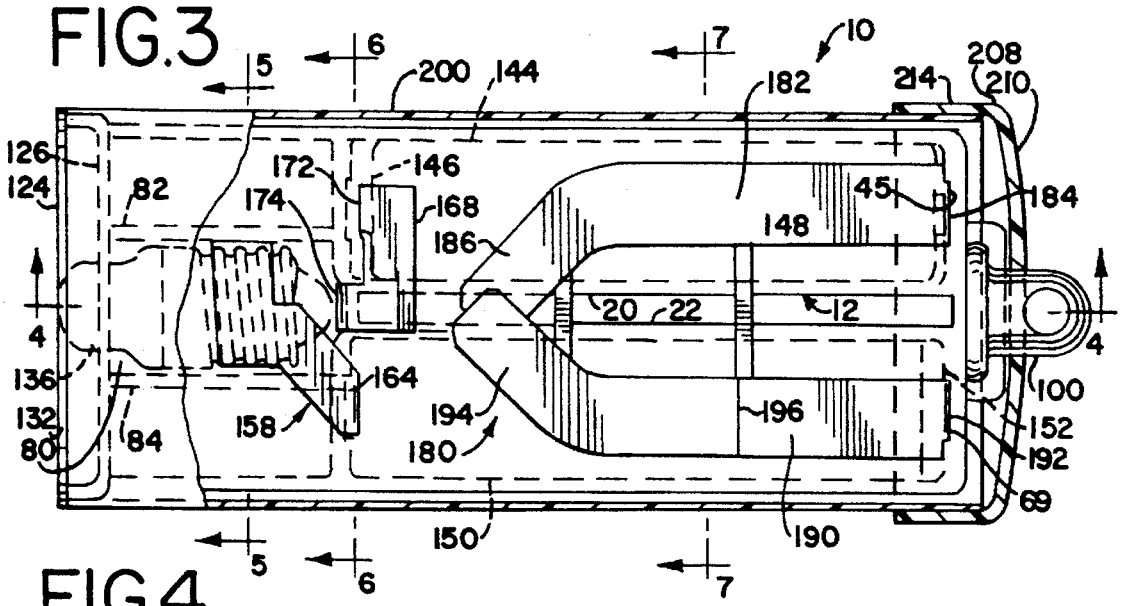
FIG. 3 is a bottom view of the flashlight shown with the jacket partially broken away.

The flashlight 10, in one embodiment of the present invention, includes a housing 12 having a first end 14 and a second end 16. The housing 12 is preferably made of plastic or other nonelectrically-conductive materials. The housing 12 includes a first cradle 20 and a second cradle 22. The first cradle 20 includes a curved generally semicylindrical wall 24 which extends between a first end 26 a second end 28. The semicylindrical wall 24 includes an interior edge 30 and a spaced apart and generally parallel linear exterior edge 32. The edges 30 and 32 extend between the first and second ends 26 and 28 of the cradle 20. The first cradle 20 also includes a first generally semicircular end wall 34 attached to the first end 26 of the semicylindrical wall 24 and a second semicircular end wall 36 attached to the second end 28 of the semicylindrical wall 24. The second end wall 36 of the cradle 20 is located at the second end 16 of the housing 12. The first end wall 34 includes a rectangular groove 38 which forms a slot 40 at the first end 26 of the semicylindrical wall 24. The second end wall 36 includes a rectangular groove 42 which forms a slot 45 at the second end 28 of the semicylindrical wall 24. The first cradle 20 forms a hollow chamber 44 having an open top extending between the interior and exterior edges 30 and 32 of the semicylindrical wall 24.

The second cradle 22 includes a curved generally semicylindrical wall 50 which extends between a first end 52 a second end 54. The semicylindrical wall 50 includes an interior edge 56 and a spaced apart and generally parallel and linear exterior edge 58. The edges 56 and 58 extend between the first and second ends 52 and 54. The second cradle 22 also includes a first generally semicircular end wall 60 attached to the first end 52 of the semicylindrical wall 50 and a second semicircular end wall 62 attached to the second end 54 of the semicylindrical wall 50. The second end wall 62 is located at the second end 16 of the housing 12. The first end wall 60 includes a rectangular groove 64 which forms a slot 66 at the first end 52 of the semicylindrical wall 50. The second end wall 62 includes a rectangular groove 68 which forms a slot 69 at the second end 54 of the semicylindrical wall 50. The second cradle 22 forms a hollow chamber 70 having an open top extending between the interior and exterior edges 56 and 58 of the semicylindrical wall 50.

Figure 6:
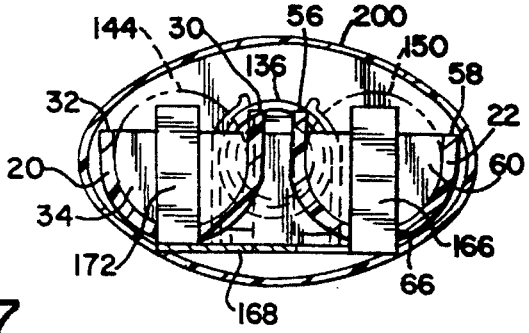
FIG. 6 is a cross-sectional view taken along lines 6—6 of FIG. 3.
Figure 7:
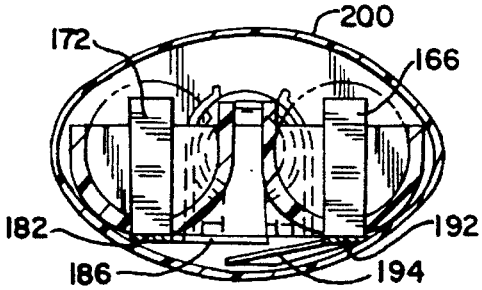
FIG. 7 is a cross-sectional view taken along lines 7—7 of FIG. 3.

The cradles 20 and 22 are constructed as substantially minor images of one another. The cradles 20 and 22 extend longitudinally parallel to one another and are both oriented in the same direction such that the chambers 44 and 70 and their respective open tops face generally in the same direction relative to one another. As best shown in FIGS. 2, 6 and 7, the cradles 20 and 22 are both open in a generally upward direction. The semicylindrical walls 24 and 50 of the first and second cradles 20 and 22 are spaced apart from one another and are connected to one another by a pair of spaced apart ribs 74.

Figure 4:
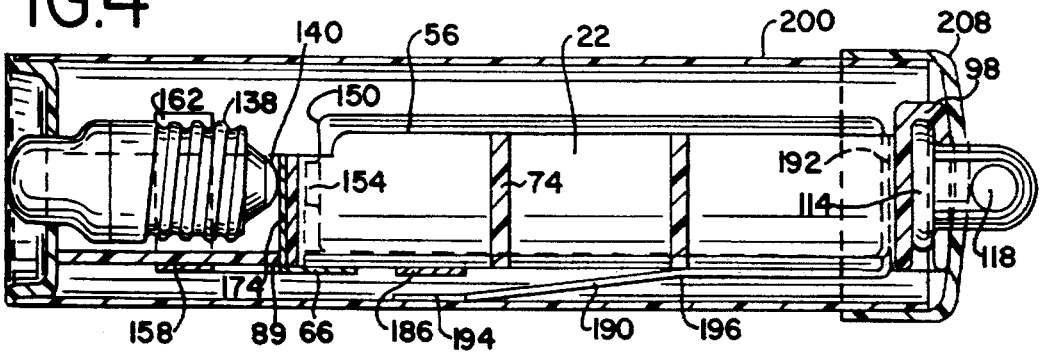
FIG. 4 is a cross-sectional view taken along lines 4—4 of FIG. 3.
Figure 5:
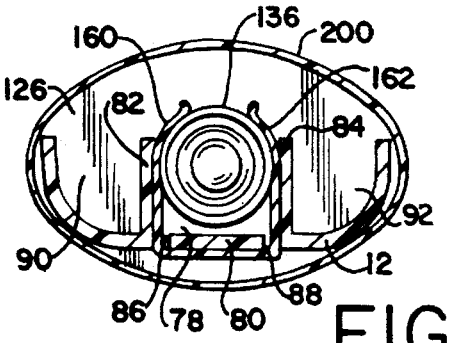
FIG. 5 is a cross-sectional view taken along lines 5—5 of FIG. 3.

The housing 12 also includes a lamp chamber 78 at the first end 14. The lamp chamber 78 is formed between a bottom wall 80 and two spaced apart side walls 82 and 84. The bottom wall 80 and side walls 82 and 84 extend from the first end walls 34 and 60 of the cradles 20 and 22 to the first end 14 of the housing 12. As best shown in FIG. 5, a first slot 86 is formed in the bottom wall 80 adjacent the side wall 82 and a second slot 88 is formed in the bottom wall 80 adjacent the side wall 84. As best shown in FIG. 4, a third slot 89 is formed in the bottom wall 80. Also as best shown in FIG. 5, the housing 12 includes a first receptacle 90 and a second receptacle 92 located on respective opposing sides of the lamp chamber 78. The receptacles 90 and 92 are each adapted to removably retain a spare lamp (not shown).

The housing 12 also includes a retention member 98 attached to the second end 16 of the housing 12 which is adapted to removably and rotatably retain a stem 100. The retention member 98 includes a generally U-shaped side wall 102 which is attached to the second end walls 36 and 62 of the cradles 20 and 22. A planar wall 104 having a generally U-shaped open-end slot 106 is attached to the side wall 102 and is spaced apart from the second end walls 36 and 62 of the cradles 20 and 22 forming a generally U-shaped groove 108 therebetween having an open end. The width of the U-shaped slot 106 is preferably slightly narrowed at its open end, such as by opposing inwardly projecting fingers or the like. The stem 100 includes a generally cylindrical body 110 having a semispherical tip 112 at one end and a generally circular flange 114 at the opposite end. A circular ridge 116 extends around the cylindrical body 110 parallel to and spaced apart from the flange 114. A bore 118 extends transversely through the cylindrical body 110 and the tip 112. The diameter of the cylindrical body 110 is sized to fit within the U-shaped slot 106 of the retention member 98 with the flange 114 located within the U-shaped groove 108 and extending underneath the wall 104. The ridge 116 is located exterior to the wall 104. The narrowed open end of the U-shaped slot 106 is adapted to selectively retain the stem 100 and to prevent the stem 100 from inadvertently disengaging from the retention member 98, while allowing the stem 100 to be selectively removed from and attached to the retention member 98 with a snap-fit. The stem 100 is rotatable about an axis 120 when the stem 100 is located in engagement with the retention member 98.

The housing 12 also includes a concave end cap 124. The end cap 124 includes a generally planar wall 126 having a generally elliptical-shaped peripheral edge. The wall 126 includes centrally located circular aperture 128. A generally elliptical-shaped side wall 130 extends generally perpendicular and outwardly from the wall 126. A ridge 132 extends around and projects outwardly from the free end of the side wall 130.

The flashlight 10 includes an illuminating lamp 136 having a first generally cylindrical terminal 138, a second terminal 140 located at one end of the lamp 136, and an illuminating bulb 142 located at the opposite end of the lamp 136.

The cradle 20 is adapted to removably receive a first battery 144 having a first terminal 146 and a second terminal 148 in the chamber 44. The second cradle 22 is adapted to removably receive a second battery 150 having a first terminal 152 and a second terminal 154 in the chamber 70. The batteries 144 and 150 may be AA, AAA, or AAAA batteries, N cell batteries, or other types of batteries as desired. In addition, while each cradle 20 and 22 preferably contains a single battery, two or more batteries may be located in a single cradle 20 or 22 in an end to end relationship if desired.

The flashlight 10 includes a lamp holder 158 which is an electrical conductor. The lamp holder 158 includes a first arm 160, a second arm 162 which is spaced apart from and extends generally parallel to the first arm 160, and a leg 164 having a bent tip 166. The arms 160 and 162 are electrically connected to one another at their bases. The arms 160 and 162 are resiliently flexible such that the tips of the arms 160 and 162 may be resiliently spread apart from one another. The first arm 160 extends through the second slot 88 into the lamp chamber 78 and the second arm 162 extends through the first slot 86 into the lamp chamber 78. The tips of the arms 160 and 162 are bent inwardly to selectively removably retain the lamp 136 therebetween within the lamp chamber 78. The first and second arms 160 and 162 are in electrical engagement with opposite sides of the first terminal 138 of the lamp 136. The lamp 136 is located within the lamp chamber 78 such that the bulb 142 extends through the aperture 128 in the end cap 124. The leg 164 of the lamp holder 158 extends at an angle from the arms 160 and 162, and the tip 166 extends through the slot 66 and into the groove 64 of the first end wall 60 in the second cradle 22 to electrically engage the second terminal 154 of the second battery 150.

The flashlight 10 also includes an electrical connector member 168. The connector member 168 includes a base 170, a first flexible arm 172 connected to the base 170, and a second flexible arm 174 connected to the base 170. The first arm 172 of the connector member 168 extends through the slot 40 and within the groove 38 of the first end wall 34 of the first cradle 20 and electrically engages the first terminal 146 of the first battery 144. The second arm 174 of the connector member 168 extends through the third slot 89 in the bottom wall 80 of the lamp chamber 78 and electrically engages the second terminal 140 of the lamp 136.

The flashlight 10 also includes an electrical switch 180 which is normally open, but which may be selectively closed to electrically connect the batteries 144 and 150 in series with the lamp 136 to illuminate the bulb 142. The switch 180 includes a first electrical conductor member 182 having an arm 184 extending outwardly at generally a right angle thereto at one end and a tip 186 at the opposite end. The first conductor member 182 extends along the bottom of the first cradle 20 on the side of the housing 12 opposite the chamber 44 and battery 144. The arm 184 extends through the slot formed by the groove 42 in the second end wall 36 of the first cradle member 20 to electrically engage the second terminal 148 of the first battery 144. The tip 186 of the first conductor member 182 extends at an angle towards the second cradle 22.

The switch 180 also includes a second electrical conductor member 190 which extends along the bottom of the second cradle 22 on the side of the housing 12 opposite the chamber 70 and battery 150. The second conductor member 190 includes an arm 192 extending outwardly therefrom at generally a right angle at one end and a tip 194 located at the opposite end of the conductor member 190. The second conductor member 190 also includes a bend or fulcrum 196 located between the arm 192 and the tip 194. The tip 194 of the second conductor member 190 is positioned to overlie the tip 186 of the first conductor member 182, but to be normally spaced apart from the tip 186. The second conductor member 190 is resiliently flexible along its length and is adapted to flexibly bend along its length between the fulcrum 196 and the tip 194 such that the tip 194 may be selectively pressed into electrical contact with the tip 186 of the first conductor member 182 and with the second terminal 148 of the first battery 144. The switch 180 is located on the opposite side of the housing 12 from the batteries 144 and 150 such that the switch 180 does not interfere with the removal or replacement of the batteries.

The flashlight 10 also includes a flexible and resilient generally tubular jacket 200 having a first end 202 and a second end 204. The jacket 200 is generally elliptical in cross section but may be formed in other shapes as desired such as circular or rectangular. The jacket 200 is preferably formed from a flexible material such as plastic and is preferably clear. A liner (not shown), such as sheet of paper, may be inserted within the jacket 200 to line the interior surface of the wall of the jacket 200. The liner may include printed indicia or advertising as desired which is visible through the jacket 200 to users of the flashlight 10. The jacket 200 is removably located around the housing 12 with the first end 202 in abutting engagement with the ridge 132 of the end cap 124. The end cap 124 substantially encloses the first end 202 of the jacket 200 and the ridge 132 prevents movement of the jacket 200 beyond the end cap 124. The jacket 200 extends around the housing 12 and extends over and encloses the switch 180 and batteries 144 and 150, and retains the batteries 144 and 150 in their respective cradles 20 and 22. When the first end 202 of the jacket 200 abuts the end cap 124, the second end 204 of the jacket 200 is located at the second end 16 of the housing 12.

A cap 208 is adapted to substantially enclose the second end 204 of the jacket 200. The cap 208 includes a wall 210 having a centrally located circular aperture 212, and a generally elliptical side wall 214 extending outwardly from the wall 210. The cap 208 is adapted to fit over the second end 16 of the housing 12 and the second end 204 of the jacket 200 such that the jacket 200 fits closely within the side wall 214. The cylindrical body 110 of the stem 100 extends through the aperture 212 in the cap 208 and is selectively rotatable within the aperture 212. A locking member 216, such as a split-ring key ring, chain, lanyard or other device is selectively attached to the stem 100 by inserting it through the bore 118. When the locking member 216 is attached to the stem 100, the locking member 216 prevents the removal of the cap 208 from the housing 12 and similarly prevents the removal of the jacket 200 from the housing 12. The stem 100 permits the locking member 216 to rotate with respect to the housing 12 and jacket 200 to prevent breakage of the stem 100.

In operation, the bulb 142 of the lamp 136 is illuminated by pressing the jacket 200 inwardly towards the bottom of the cradles 20 and 22 and thereby resiliently bending the second conductor member 190 such that the tip 194 electrically engages the tip 186 of the first conductor member 182 and the second terminal 148 of the first battery 144, thereby completing a circuit between the batteries 144 and 150 and the lamp 136. When the pressure on the jacket 200 is released, the jacket 200 resiliently returns to its original unflexed orientation and the tip 194 of the second conductor member 190 resiliently flexes away from the first conductor member 182 to break or open the electrical connection between the second conductor member 190 and the first battery 144.

When one or both of the batteries 144 or 150 require replacement, the locking member 216 is removed from the stem 100. The cap 208 is then slid along a longitudinal axis 218 to remove the cap 208 from the second end 204 of the jacket 200. The jacket 200 may then be slid along the axis 218 to remove the jacket 200 from the housing 12. When the jacket 200 is removed from the housing 12, the housing 12 is positioned such that the cradles 20 and 22 are open in a vertically upward orientation such that the batteries 144 and 150 remain seated within the cradles 20 and 22 after the jacket 200 is removed. Once the jacket 200 is removed, the batteries 144 and/or 150 may be selectively removed from the cradles and replaced with fresh batteries. The lamp 136 may also be replaced if desired. The cradles 20 and 22 do not grip the batteries 144 or 150 and allow easy removal and replacement of the batteries.

Once the new batteries have been inserted within the cradles 20 and 22, the second end 16 of the housing 12 is inserted within the first end 202 of the jacket 200 and the jacket 200 is slid along the housing 12 until the first end 202 engages the ridge 132 of the end cap 124. The cap 208 is then placed over the second end 204 of the jacket 200 such that the stem 100 extends through the aperture 212 in the cap 208. The locking member 216 is then attached to the stem 100 which thereby holds the cap 208 and jacket 200 in position with respect to the housing 12.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A flashlight comprising:

a housing extending between a first end and a second end and having a first side and an opposing second side, said housing including a first cradle having a chamber with an open top adapted to removably receive a first battery having a first terminal and a second terminal, a second cradle having a chamber with an open top adapted to removably receive a second battery having a first terminal and a second terminal, said open tops of said first and second cradles being located in said first side of said housing, and a lamp chamber located at said first end of said housing;

a lamp located within said lamp chamber, said lamp including a first terminal and a second terminal;

a lamp holder located within said lamp chamber, said lamp holder adapted to removably retain said lamp within said lamp chamber and to electrically contact said first terminal of said lamp;

an electrical switch adapted to provide selective electrical communication between the first and second batteries and said lamp, said electrical switch including a first electrical conductor member having a first end adapted to electrically contact the second battery and a second end normally located out of electrical contact with the first battery, said first electrical conductor member being flexibly bendable such that said second end of said first electrical conductor member may be selectively pressed into electrical contact with the first battery, said second end of said first electrical conductor member being located adjacent said second side of said housing such that said first electrical conductor member does not interfere with the removal and replacement of the first and second batteries in said chambers of said cradles; and a flexible jacket covering said electrical switch and said chambers of said first and second cradles, said jacket adapted to be pressed inwardly to close said electrical switch and thereby illuminate said lamp.

2. The flashlight of claim 1 wherein said housing includes a receptacle at said first end located adjacent to said lamp chamber.

3. The flashlight of claim 1 wherein said lamp holder includes a first arm and a second arm, said first and second arms being spaced apart from one another and adapted to removably retain said lamp therebetween.

4. The flashlight of claim 3 wherein said lamp holder includes a leg adapted to electrically contact said second battery.

5. The flashlight of claim 3 including an electrical connector member having a first end and a second end, said first end of said connector member adapted to electrically contact said first battery and said second end of said connector member adapted to electrically contact said second terminal of said lamp.

6. The flashlight of claim 1 wherein said first electrical conductor member of said switch includes a fulcrum adapted to substantially limit the bending of said first electrical conductor member to a portion thereof located between said fulcrum and said second end of said first electrical conductor member when said second end is pressed into electrical contact with said first battery.

7. The flashlight of claim 6 wherein said electrical switch includes a second electrical conductor member having a first end and a second end, said first end adapted to electrically contact said first battery, said first electrical conductor member being normally spaced apart from said second electrical conductor member, but adapted to electrically contact said second electrical conductor member when said second end of said first electrical conductor member is pressed into electrical contact with said first battery.

8. The flashlight of claim 1 including a stem rotatably attached to said second end of said housing, and a cap adapted to removably retain said jacket over the first and second batteries, said cap including an aperture, said stem extending through said aperture.

9. A flashlight comprising:

a housing having a first end and a second end, a cradle having a chamber adapted to removably receive a battery, and a lamp chamber;

a lamp located within said lamp chamber;

an electrical switch adapted to provide selective electrical communication between the battery and said lamp;

a flexible jacket having a first end and a second end, said jacket extending around said housing and covering said electrical switch and said chamber of said cradle, said jacket adapted to be pressed inwardly to close said electrical switch and thereby illuminate said lamp, said jacket adapted to be selectively removed from said housing to allow replacement of the battery;

a selectively removable cap engaging said second end of said jacket, said cap adapted to selectively retain said jacket around said housing, said cap including an aperture;

a stem rotatably attached to said second end of said housing, said stem extending through said aperture in said cap; and a locking means attached to said stem for selectively preventing removal of said cap and said jacket from said housing.

10. The flashlight of claim 9 wherein said electrical switch and said chamber of said cradle are located on opposite sides of said housing such that said electrical switch does not interfere with the removal and replacement of the battery.

11. The flashlight of claim 9 including a retention member adapted to removably and rotatably connect said stem to said housing.

12. The flashlight of claim 11 wherein said retention member includes a wall having a slot with an open end, said stem adapted to rotatably extend through said slot and to be selectively removable from said slot.

13. The flashlight of claim 12 wherein the width of said slot is narrowed at said open end such that said stem is snap fit within said slot.

14. The flashlight of claim 12 wherein said wall of said retention member is spaced apart from said housing forming a groove therebetween, said stem including a flange rotatably located within said groove.

15. The flashlight of claim 14 wherein said groove has an open end such that said flange may be selectively removed from said groove.

16. A flashlight comprising:

a housing extending between a first end and a second end and having a first side and an opposing second side, said housing including a first cradle having a chamber with an open top adapted to removably receive a first battery having a first terminal and a second terminal, a second cradle having a chamber with an open top adapted to removably receive a second battery having a first terminal and a second terminal, said open tops of said first and second cradles being located in said first side of said housing, and a lamp chamber located at said first end of said housing;

a lamp located within said lamp chamber, said lamp including a first terminal and a second terminal;

a lamp holder having a first arm, a second arm and a leg, said first and second arms of said lamp holder being spaced apart from one another and adapted to removably retain said lamp therebetween, said first and second arms adapted to electrically contact said first terminal of said lamp, said leg of said lamp holder adapted to electrically contact the second battery;

an electrical switch adapted to provide selective electrical communication between the first and second batteries and said lamp; and a flexible jacket covering said electrical switch and said chambers of said cradles, said jacket adapted to be pressed inwardly to close said electrical switch and thereby illuminate said lamp.

* * * * *